US012220074B2

(12) United States Patent
Rogers

(10) Patent No.: US 12,220,074 B2
(45) Date of Patent: Feb. 11, 2025

(54) VESSEL RETAINING DEVICE

(71) Applicant: Jake H. Rogers, Riverside, CT (US)

(72) Inventor: Jake H. Rogers, Riverside, CT (US)

( * ) Notice: Subject to any disclaimer, the term of this patent is extended or adjusted under 35 U.S.C. 154(b) by 0 days.

(21) Appl. No.: 18/370,526

(22) Filed: Sep. 20, 2023

(65) Prior Publication Data

US 2024/0090692 A1 Mar. 21, 2024

Related U.S. Application Data

(60) Provisional application No. 63/408,676, filed on Sep. 21, 2022.

(51) Int. Cl.
*A47G 29/08* (2006.01)

(52) U.S. Cl.
CPC ..... *A47G 29/08* (2013.01)

(58) Field of Classification Search
CPC ..... A47G 29/08
USPC ..... 248/311.2
See application file for complete search history.

(56) References Cited

U.S. PATENT DOCUMENTS 3,164,343 A * 1/1965 Cucullo ..... A47G 7/044 248/27.8
3,326,504 A * 6/1967 St Lawrence ..... A47G 7/044 248/154
3,945,596 A * 3/1976 Marraccini ..... A47C 7/62 248/246
4,754,841 A * 7/1988 Koffski ..... E06C 9/04 248/217.1
5,377,944 A * 1/1995 Getsinger ..... G09F 17/00 248/512
5,435,099 A * 7/1995 Conway ..... A01G 9/02 47/65.5
5,597,148 A * 1/1997 Gospodarich ..... A47G 23/0225 297/188.21
6,059,138 A 5/2000 Abruyere
6,505,802 B2 * 1/2003 Fowler ..... B60N 3/103 248/230.5
7,806,379 B1 * 10/2010 Chen ..... B60N 3/103 248/311.2
9,714,061 B1 7/2017 Delgado deLeon
2004/0222345 A1 * 11/2004 Lindsay ..... B60N 3/103 248/231.61

(Continued)

FOREIGN PATENT DOCUMENTS

AU 2021200907 A1 12/2021
CN 202152061 U 2/2012

(Continued)

*Primary Examiner* — Anita M King
(74) *Attorney, Agent, or Firm* — Troutman Pepper Locke LLP; Gabrielle L. Gelozin

(57) ABSTRACT

A vessel retaining device for attachment to a support structure includes a holder portion configured to retain a vessel, the holder portion defining a first vertical axis and having an opening for receiving the vessel. The holder portion includes a base for seating the vessel and a continuous wall extending upward from the base configured to surround the vessel. The vessel retaining device also includes an attachment portion operatively associated with a section of the continuous wall and configured to mount the device to a support structure, the attachment portion defining a second vertical axis parallel to the first vertical axis.

19 Claims, 6 Drawing Sheets

(56) References Cited

U.S. PATENT DOCUMENTS

| | | | | |
|---|---|---|---|---|
| 2005/0236531 | A1* | 10/2005 | Joeckel | F16M 11/28 248/133 |
| 2007/0144935 | A1* | 6/2007 | Davis | A47G 23/0225 206/562 |
| 2019/0099026 | A1 | 4/2019 | Yadin | |
| 2021/0068536 | A1 | 3/2021 | Wheat | |

FOREIGN PATENT DOCUMENTS

| | | | |
|---|---|---|---|
| CN | 204743586 | U | 11/2015 |
| CN | 106361111 | A | 2/2017 |
| CN | 208550957 | U | 3/2019 |
| CN | 209678104 | U | 11/2019 |
| CN | 213909615 | U | 8/2021 |
| CN | 215271918 | U | 12/2021 |
| DE | 202009005736 | U1 | 7/2009 |
| JP | 3123914 | B2 | 1/2001 |
| JP | 2014217439 | A | 11/2014 |
| JP | 2021514691 | A | 6/2021 |
| KR | 1020160149111 | A1 | 12/2016 |
| WO | 2012022893 | A1 | 2/2012 |

* cited by examiner

VESSEL RETAINING DEVICE

CROSS-REFERENCE TO RELATED APPLICATIONS

This application claims priority to and the benefit of U.S. Provisional Application No. 63/408,676, filed Sep. 21, 2022, the entire content of which is herein incorporated by reference in their entirety.

BACKGROUND OF THE DISCLOSURE

1. Field of the Disclosure

The present disclosure relates to vessel retaining devices, and more particularly to a device for holding a vessel relative to a support structure.

2. Description of Related Art

Traditionally, vessel retaining device use clipping mechanisms which limits the types of furniture which they can be attached to. There is always a need in the art for improvements to vessel retaining devices, and in particular to beverage retaining devices configured to attach to support structures, for example furniture. This disclosure provides a solution for this need.

SUMMARY OF THE DISCLOSURE

The subject disclosure is directed to a new and useful vessel retaining device for attachment to a support structure includes a holder portion configured to retain a vessel, the holder portion defining a first vertical axis and having an opening for receiving the vessel. The holder portion includes a base for seating the vessel and a continuous wall extending upward from the base configured to surround the vessel. The vessel retaining device also includes an attachment portion operatively associated with a section of the continuous wall and configured to mount the device to a support structure, the attachment portion defining a second vertical axis parallel to the first vertical axis. The attachment portion includes a first sidewall extending outward from the continuous wall in a first direction, the first direction perpendicular to the second vertical axis, a second side wall, extending outward from the continuous wall in a second direction that is the same as the first direction, and a third sidewall, extending between the first sidewall and the second sidewall perpendicular to the first sidewall and the second sidewall.

In certain embodiments, the first sidewall and the second sidewall include a lower edge. The lower edge of the first and second sidewalls is proximate the base. The lower edge of the first and second sidewalls is substantially axially aligned with the base of the holder portion. The third sidewall includes a lower edge that is axially above the lower edge of the first and second sidewalls.

An upper edge of each of the first sidewall, the second sidewall, and the third sidewall is below an upper edge of the continuous wall. The upper edge of the continuous wall is proximate the opening of the holder portion. An axial height of the third sidewall is less than an axial height of the first and second sidewalls.

In certain embodiments, the first sidewall includes a first arcuate feature extending from a lower corner of the first sidewall to a first lower corner of the third sidewall and the second sidewall includes a second arcuate feature extending from a lower corner of the second sidewall to a second lower corner of the third sidewall. A section of the continuous wall forms a fourth sidewall, opposite the third sidewall. The first side wall, the second sidewall, the third sidewall, and fourth sidewall form an aperture, wherein the attachment portion is configured to be disposed over a post portion of the support structure through the aperture. One or more triangular features are tangential with and extend outwardly from the continuous wall to connect between the continuous wall and the first sidewall and between the continuous wall and the second sidewall.

An upper edge of the continuous wall is proximate the opening of the holder portion and the upper edge of the continuous wall is rounded. A lower edge of the continuous wall is proximate the base and the lower edge of the continuous sidewall is flat.

In certain embodiments, a thickness of the sidewall is about 0.01 inches to about 0.15 inches. A width of the attachment portion is about 2 inches to about 3 inches. A thickness of each of the first sidewall, the second sidewall, and the third sidewall is about 0.2 inches. A height of the holder portion is about 3 inches. A height of the attachment portion is about 2.7 inches. A width of the holder portion is about 3 inches to about 5 inches.

In certain embodiments, the attachment portion can be configured to slidably engage with the support structure. The holder portion can have a generally cylindrical shape. The device can be additively manufactured. The holder portion and the attachment portion can be integrally formed. The vessel can include cups, flowerpots, and or bottles, and the support structure can include a bed frame.

The disclosure is also directed to a cup holder for holding a cup, the cup holder configured for attachment to a support structure. The cup holder includes a cup holder portion defining a cup holder interior configured to accept a cup and support the cup therein. The cup holder portion includes a circular base configured to seat the cup thereon defining a circumferential lower cup holder edge about a central cup axis, a continuous peripheral sidewall extending axially from the lower cup holder edge to an upper cup holder edge, and an opening defined in the continuous peripheral sidewall to allow access to the cup holder interior.

The cup holder further includes an attachment portion for attaching the cup holder to a structure engaged with or integrally formed with the continuous peripheral sidewall, wherein the attachment portion includes, a polygonal aperture defining an upper attachment edge about an attachment axis, a first side extending axially downward from the upper attachment edge to a first lower attachment edge and extending radially outward from the continuous peripheral sidewall in a first direction, a second side extending axially downward from the upper attachment edge to a second lower attachment edge and extending radially outward from the continuous peripheral sidewall in a second direction, and a third side extending axially downward from the upper attachment edge to a third lower attachment edge and extending between the first and second sides. The third lower attachment edge is above the first and second lower attachment edges. A portion of continuous peripheral sidewall forms a fourth side, the first, second, third, and fourth sides forming an outer boundary of the aperture, the aperture configured to slidably engage with the structure along the attachment axis to attach the cup holder to the structure.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION OF THE DISCLOSURE

Figure 1:
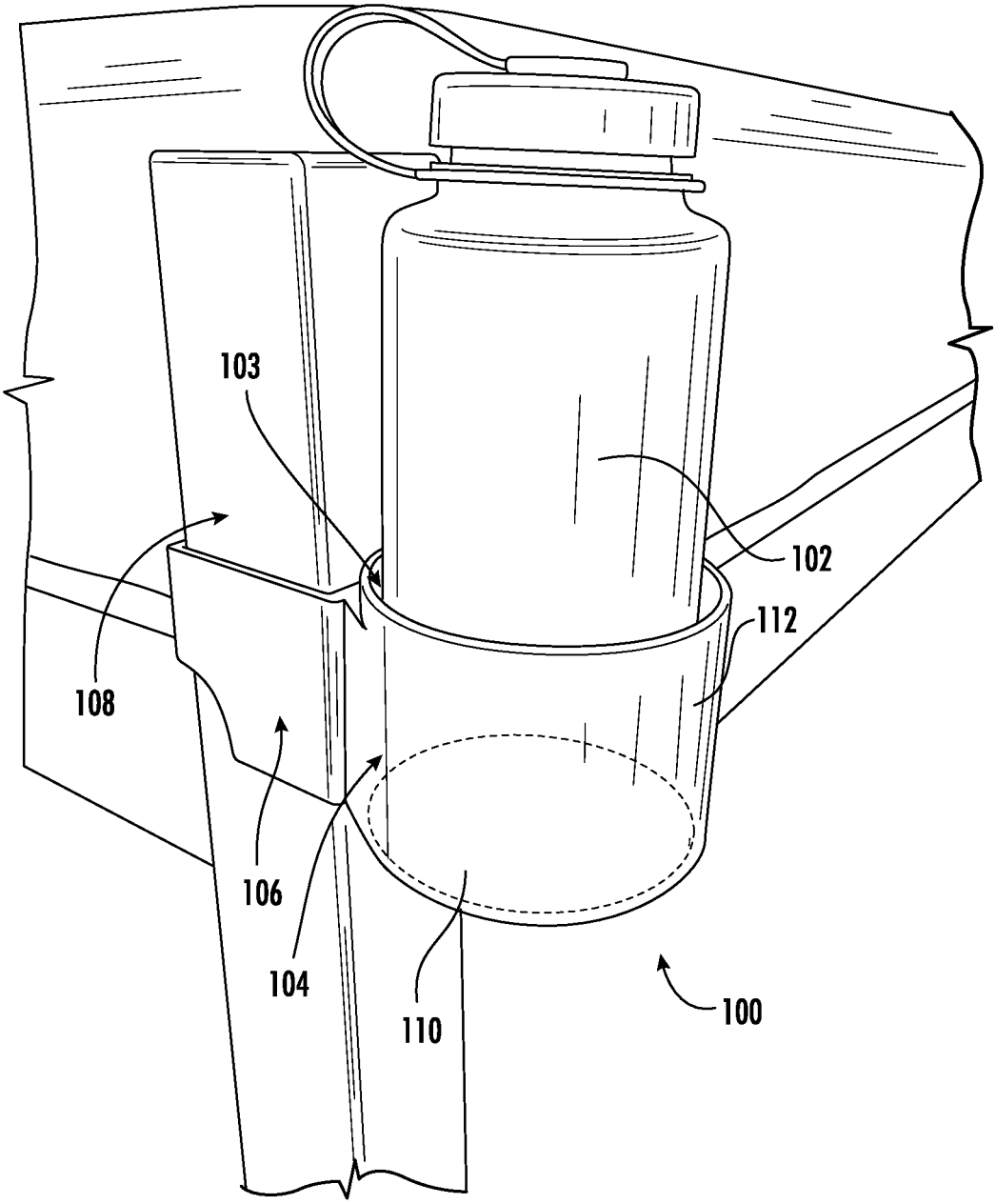
FIG. 1 is a perspective view of a vessel retaining device in accordance with this disclosure, showing the device in an environment and attached to a support structure retaining a vessel.

Reference will now be made to the drawings wherein like reference numerals identify similar structural features or aspects of the subject disclosure. For purposes of explanation and illustration, and not limitation, an illustrative view of an embodiment of a vessel retaining device in accordance with the disclosure is shown in FIG. 1 and is designated generally by reference character 100. Other embodiments and/or aspects of this disclosure are shown in FIGS. 2-6.

Figure 2:
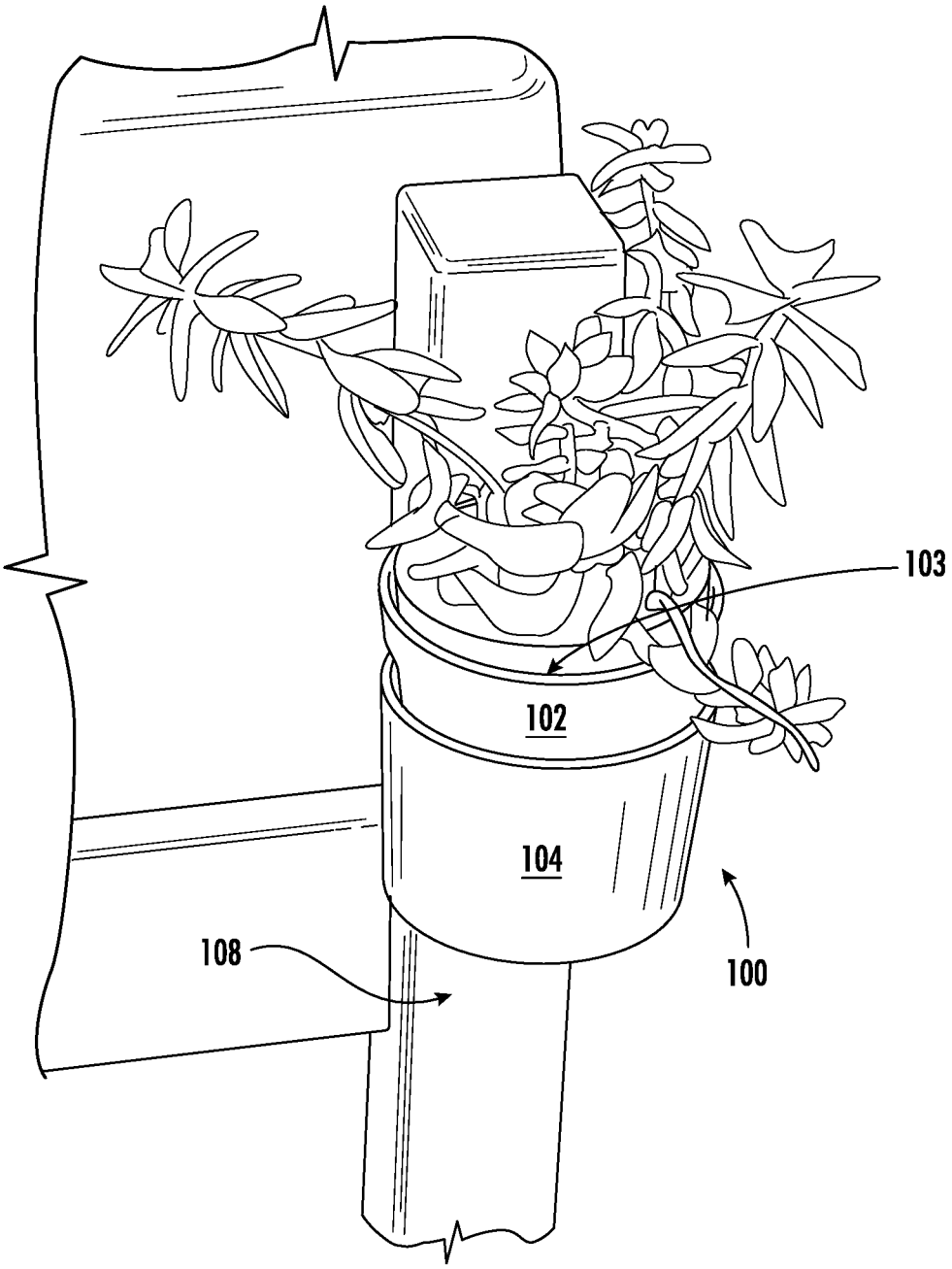
FIG. 2 is a perspective view of the device of FIG. 1 in another environment and attached to a support structure retaining another vessel.
Figure 3:
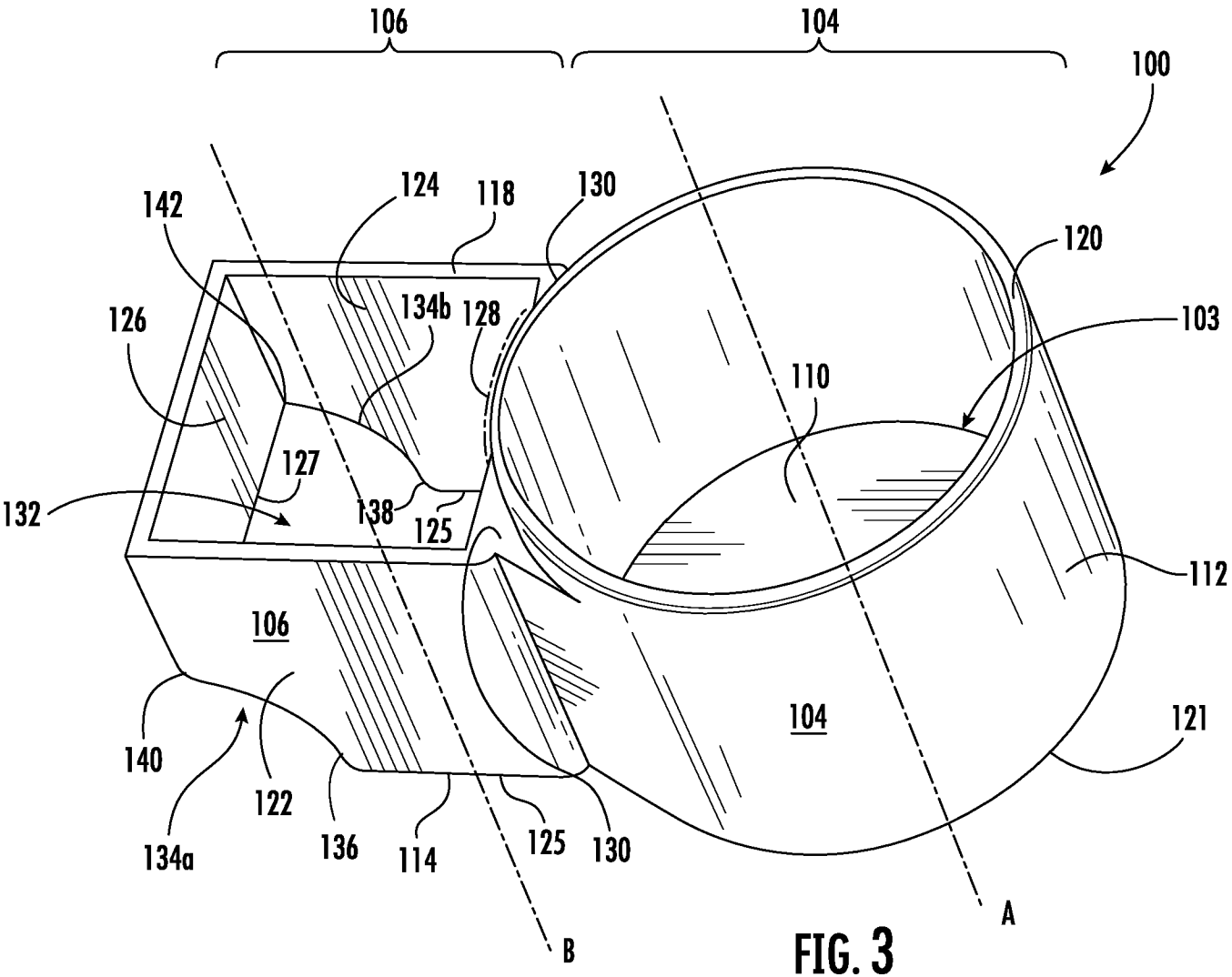
FIG. 3 is a top down, right side perspective view of the device of FIG. 1, showing an opening in the holder portion.
Figure 4:
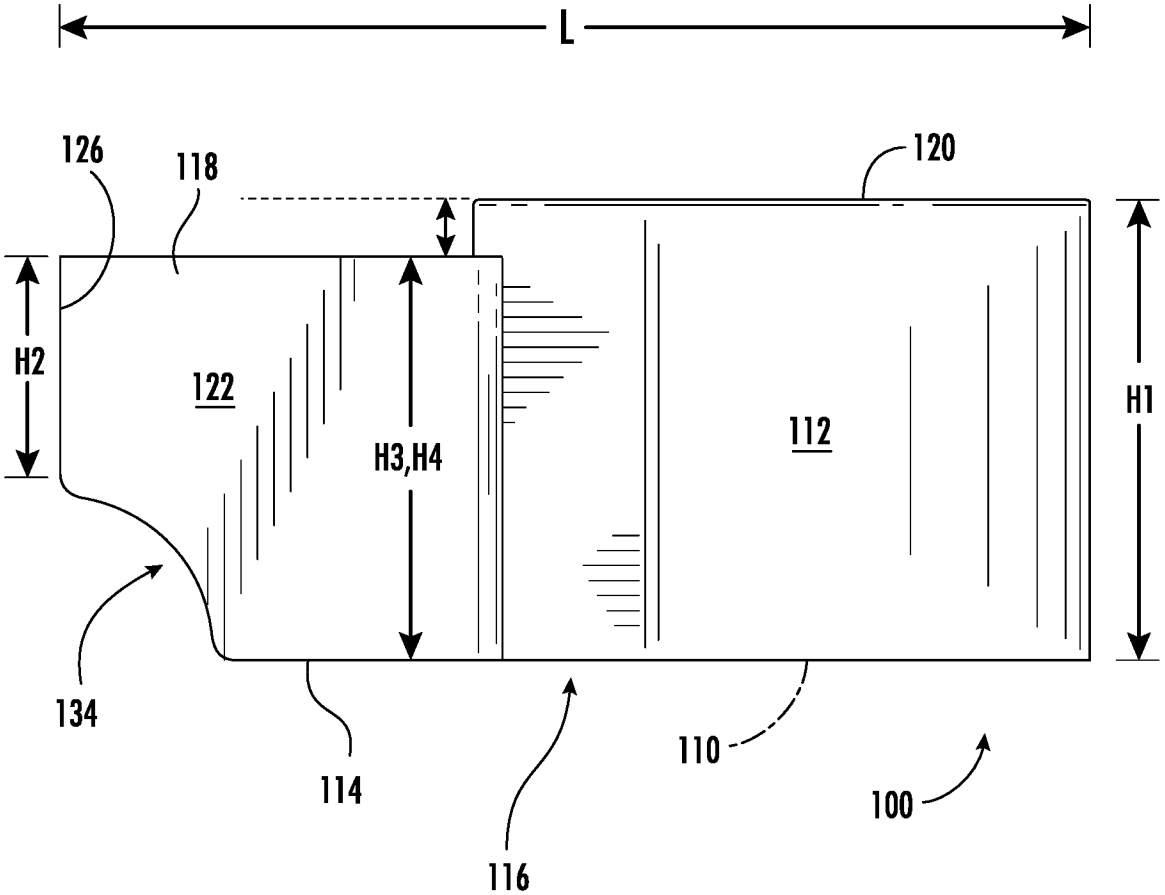
FIG. 4 is a right side elevation view of the device of FIG. 1, showing relative dimensions of the portions.

With reference to FIGS. 1 and 2, a vessel retaining device 100 for attachment to a support structure 108 includes a holder portion 104 configured to retain a vessel 102, the holder portion 104 defining a first vertical axis A (e.g., as shown in FIG. 3) and having an opening 103 for receiving the vessel 102. The holder portion 104 includes a base 110 for seating the vessel 102 and a continuous wall 112 extending upward from the base 110 configured to surround the vessel 102. The continuous sidewall 112 can be circumferential, rectangular, or any other suitable shape capable of holding a vessel.

The vessel retaining device 100 also includes an attachment portion 106 operatively associated with a section of the continuous wall 112 and configured to mount the vessel retaining device 100 to a support structure 108, the attachment portion 106 defining a second vertical axis B (e.g., as shown in FIG. 3) parallel to the first vertical axis A.

With reference to FIGS. 3-6, the attachment portion 106 includes a first sidewall 122 extending outward from the continuous wall 112 in a first direction, the first direction perpendicular to the second vertical axis B and a second side wall 124, extending outward from the continuous wall 112 in a second direction that is the same as the first direction. A third sidewall 126, extends between the first sidewall 122 and the second sidewall 124 perpendicular to the first sidewall 122 and the second sidewall 124.

Figure 5:
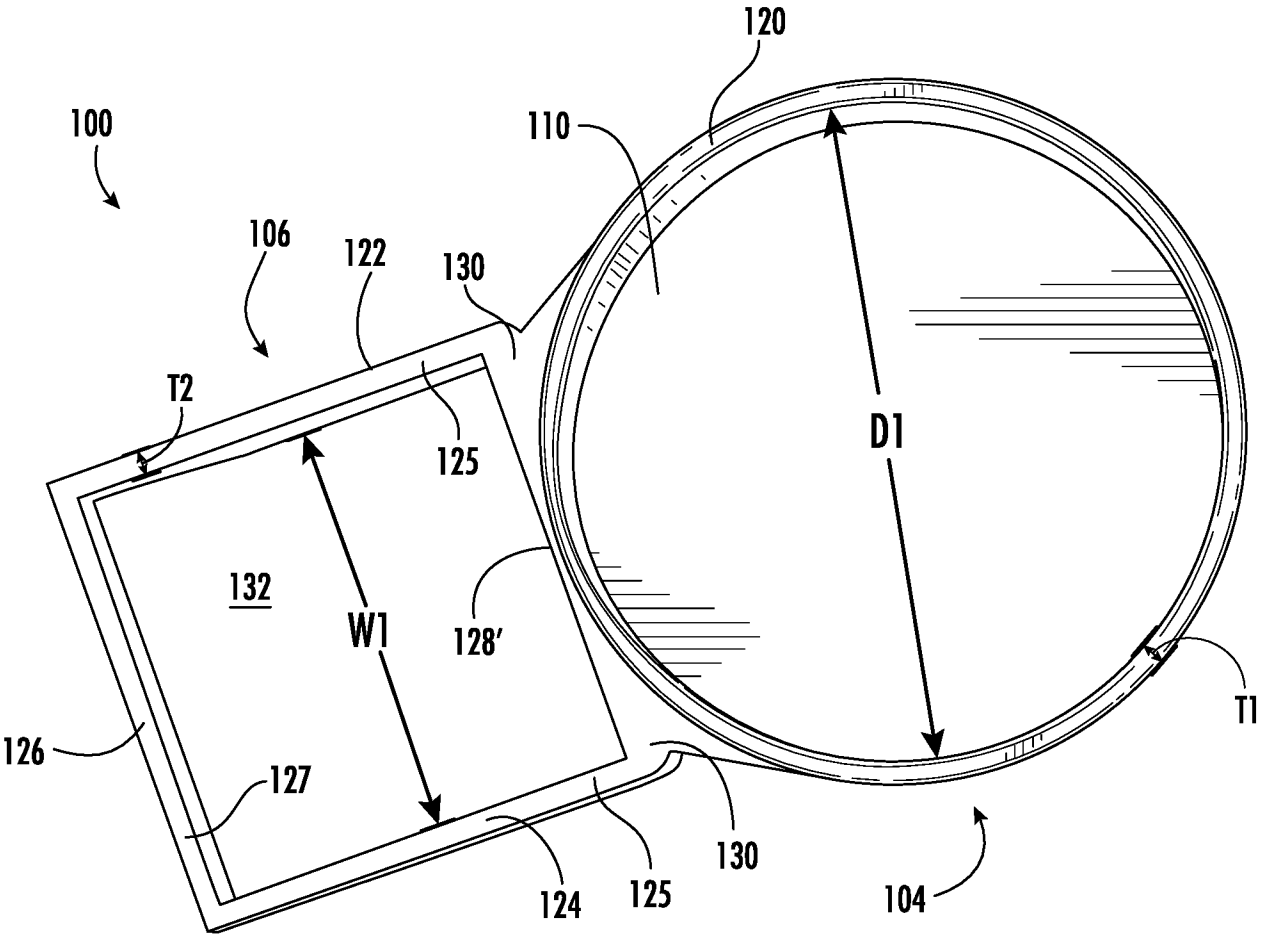
FIG. 5 is a bird's eye view of the device of FIG. 1 (e.g., looking down into the opening through an attachment aperture.
Figure 6:
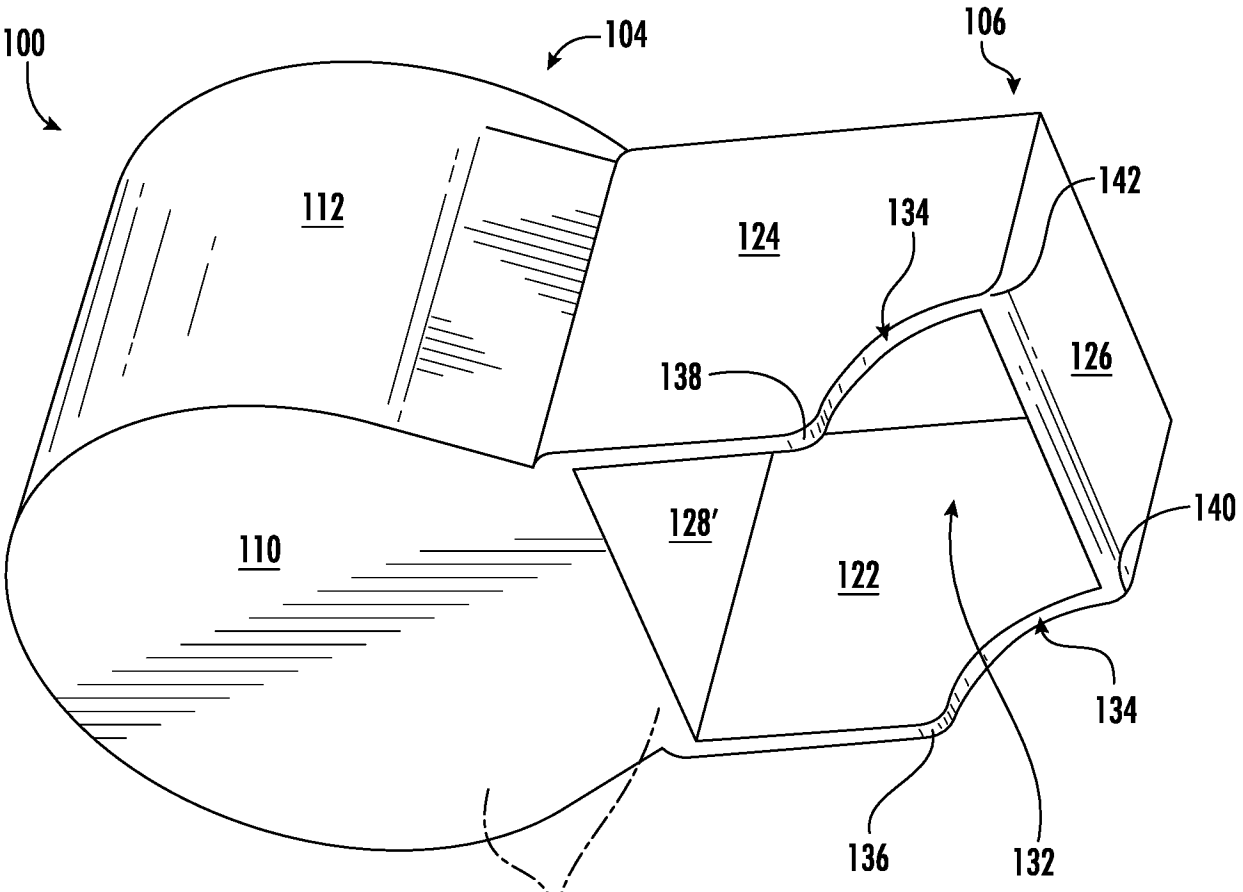
FIG. 6 is a bottom up, left side perspective view of the device of FIG. 1, showing a base of the holder portion from a bottom side.

In certain embodiments, the first sidewall 122 and the second sidewall 124 include a lower edge 125 (e.g., as best shown in FIG. 5). The lower edge 125 of the first and second sidewalls 122, 124 is proximate the base 110 and is substantially axially aligned with the base 110 of the holder portion 104 (e.g., the lower edge 125 of the first and second sidewalls 122, 124 can be flush with a bottom surface 116 of the base 110). The third sidewall 126 includes a lower edge 127 (e.g., as best shown in FIG. 5) that is axially above the lower edge 125 of the first and second sidewalls 122, 124.

An upper edge 118 of each of the first sidewall, the second sidewall, and the third sidewalls 122, 124, 126 is below an upper edge 120 of the continuous wall 112. The upper edge 120 of the continuous wall 112 is proximate the opening 103 of the holder portion 104. An axial height of the third sidewall 126 is less than an axial height of the first and second sidewalls 122, 124. In embodiments, e.g., as shown, the axial height of the third sidewall 126 is approximately half the axial height of the first and second sidewalls 122, 124 as shown, for example, about 0.5 inches shorter, or about 0.4 inches shorter. For example, the axial height of the third sidewall 126 being less than the first and second sidewalls 122, 124 provides increased support when the vessel retaining device 100 is attached to a support structure 108, which can add stability to the vessel retaining device when holding heavier vessels.

Any other axial heights and height relationships between the first, second, and third sidewalls 122, 124, 126 is contemplated herein. An upper edge 120 of the continuous wall 112 is proximate the opening 103 of the holder portion 104 and the upper edge 120 of the continuous wall 112 is rounded. A lower edge 121 (e.g., as best shown in FIG. 5) of the continuous wall 112 is proximate the base 110 and the lower edge 121 of the continuous sidewall 112 is flat.

In embodiments, the first sidewall 122 defines a first plane and the second sidewall defines a second plane. The planes of the first sidewall 122 and the second sidewall 124 are parallel to each other. The third sidewall 126 defines a third plane which is perpendicular to the first and second planes. The lower edge 125 of the first and second sidewalls 122, 124 defines a fourth plane and the base 110 defines a fifth plane, such that the fourth and fifth planes are coplanar, and the lower edge 125 of the first and second sidewalls 122, 124 is coplanar with a plane of the base 110 of the holder portion 104. The upper edge 118 of the first and second sidewalls defines a sixth plane and the upper edge 120 of the holder portion defines a seventh plane, such that the sixth and seventh planes are axially offset from one another. The lower edge of the third sidewall 126 defines an eighth plane such that the eighth plane and the fourth plane are axially offset.

With continued reference to FIGS. 3-6, in certain embodiments, the first sidewall 122 includes a first arcuate feature 134*a* extending from a lower corner 136 of the first sidewall 122 to a first lower corner 140 of the third sidewall 126 and the second sidewall 124 includes a second arcuate feature 134*b* extending from a lower corner 138 of the second sidewall 124 to a second lower corner 142 of the third sidewall 126. A section of the continuous wall 112 forms a fourth sidewall 128 (having a curved portion and flat portion 128'), opposite the third sidewall 126. The first side wall 122, the second sidewall 124, the third sidewall 126, and fourth sidewall 128 form an aperture 132, so that the attachment portion 106 can be placed over a post portion of the support structure 108 through the aperture 132. The aperture 132 can be generally rectangular or any other shape configured to fit over a variety of different support structures. One or more triangular features 130 are substantially along a tangent line and extend radially outward from the continuous wall 112 to connect between the continuous wall 112 and the first sidewall 122 and between the continuous wall 112 and the second sidewall 124.

In certain embodiments, a thickness of the continuous wall 112 can be about 0.01 inches to about 0.15 inches for example. A width of the attachment portion 106 can be about 2 inches to about 3 inches. A thickness of each of the first sidewall, the second sidewall, and the third sidewall 122, 124, 126 can be about 0.2 inches. A height of the holder portion 104 can be about 3 inches. A height of the attachment portion 106 can be about 2.7 inches. A width of the holder portion 104 can be about 3 inches to about 5 inches. An axial length of the vessel retaining device can be about 7 inches.

A height H1 of the holder portion 104, e.g., from the base 110 to the upper edge 120 of the sidewall 112 can be about 2 inches to about 4 inches, and more particularly can be about 3.1 inches. A width or inner diameter D1 of the holder portion 104 can be between about 2 inches and 5 inches, and more particularly can be about 4 inches. In embodiments, a thickness T1 of the sidewall 112 can be between about 0.01 and about 0.3 inches, or more particularly, about 0.14 inches. Accordingly, an outer diameter of the first portion 104 can be between about 4.01 inches and about 4.3 inches, and more particularly about 4.15 inches.

A height H2 of the third sidewall 126 can be less than a height H3 of the first and second sidewalls 122, 124. In embodiments, a width W1 of the aperture 132 can be about 2 to 3 inches. In certain embodiments having a square aperture 132 (e.g., as shown), the dimensions of the aperture 132 can be about 2.5 inches by about 2.5 inches, and more particularly about 2.57 inches by about 2.57 inches. Each of the first, second, and third sidewalls 122, 124, 26 can have a thickness T2 between about 0.1 and 0.3 inches, and more particularly, about 0.14 inches.

In embodiments, the thickness T2 can be the same or different than that of T1 (e.g., the thickness T2 of the second sidewall can be the same or different than the thickness T1 of the first sidewall). A height H4 of the second portion 106, e.g., from the lower edge 114 of the second portion 106 to the upper edge 118 of the second portion 106 can be between about 1 inch and about 4 inches, and more particularly can be about 2.7 inches. This height H4 can be the same as the height H3 of the first and second sidewalls 122, 124. In embodiments, an axial length L of the device 100 can be between about 5 inches to about 9 inches, and more particularly can be about 7 inches.

In certain embodiments, the attachment portion 104 can be configured to slidably engage with the support structure 108 (e.g., as shown in FIGS. 1 and 2). In certain embodiments, the holder portion 104 can have a generally cylindrical shape. In certain embodiments, the vessel retaining device 100 can be additively manufactured, for example, such that the holder portion 104 and the attachment portion 106 can be integrally formed as a unitary body (e.g., such that they are one piece). In certain embodiments, the holder portion 1904 and the attachment portion 106 can also be two separate pieces mounted together by any mounting means (e.g., screwed, glued, etc.).

In certain embodiments, the holder portion can be configured for holding any suitable vessel, for example cups, flowerpots, bottles, or any other vessel of any shape and size. The vessel retaining device 100 can also be configured to retain any one or more items that can fit within the first portion (e.g., bedside items, writing utensils, headphones, and the like). In certain embodiments, the attachment portion can be configured to attach to any suitable support structure for example, a bed frame or any other support structure for which the attachment portion can be attached.

In accordance with at least one aspect of this disclosure, a cup holder for holding a cup therein can be configured to attach a support structure. In embodiments the cup holder includes cup holder portion defining a cup holder interior configured to accept a cup and support the cup therein. The cup holder portion includes a circular base configured to seat the cup thereon defining a circumferential lower cup holder edge about a central cup axis, a continuous peripheral sidewall extending axially from the lower cup holder edge to an upper cup holder edge, and an opening defined in the continuous peripheral sidewall to allow access to the cup holder interior.

The cup holder further includes an attachment portion for attaching the cup holder to a structure engaged with or integrally formed with the continuous peripheral sidewall. The attachment portion includes, a polygonal aperture defining an upper attachment edge about an attachment axis. The cup holder further includes a first side extending axially downward from the upper attachment edge to a first lower attachment edge and extending radially outward from the continuous peripheral sidewall in a first direction, a second side extending axially downward from the upper attachment edge to a second lower attachment edge and extending radially outward from the continuous peripheral sidewall in a second direction, and a third side extending axially downward from the upper attachment edge to a third lower attachment edge and extending between the first and second sides. In certain embodiments, third lower attachment edge is above the first and second lower attachment edges. A portion of continuous peripheral sidewall forms a fourth side, and the first, second, third, and fourth sides forming an outer boundary of the aperture The aperture configured to slidably engage with the structure along the attachment axis to attach the cup holder to the structure (e.g., the second vertical axis).

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the apparatus and methods of the subject disclosure have been shown and described, those skilled in the art will readily appreciate that changes and/or modifications may be made thereto without departing from the scope of the subject disclosure.

What is claimed is:

1. A vessel retaining device for attachment to a support structure, comprising:

a holder portion configured to retain a vessel, the holder portion defining a first vertical axis and having an opening for receiving the vessel, the holder portion including:

a base for seating the vessel; and a continuous wall extending upward from the base configured to surround the vessel; and an attachment portion operatively associated with a portion of the continuous wall and configured to mount the device to a support structure, the attachment portion defining a second vertical axis parallel to the first vertical axis, the attachment portion including:

a first sidewall extending outward from the continuous wall in a first direction, wherein the first direction is perpendicular to the second vertical axis, a second sidewall, extending outward from the continuous wall in a second direction that is the same as the first direction, and a third sidewall, extending between the first sidewall and the second sidewall perpendicular to the first sidewall and the second sidewall, wherein the first sidewall and the second sidewall include a lower edge, wherein the lower edge of the first and second sidewalls is proximate the base, wherein the lower edge of the first and second sidewalls is substantially axially aligned with the base of the holder portion, and wherein the third sidewall includes a lower edge that is axially above the lower edge of the first and second sidewalls.

2. The device of claim 1, wherein an upper edge of each of the first sidewall, the second sidewall, and the third sidewall is below an upper edge of the continuous wall, wherein the upper edge of the continuous wall is proximate the opening of the holder portion.

3. The device of claim 2, wherein an axial height of the third sidewall is less than an axial height of the first and second sidewalls.

4. The device of claim 3, wherein the first sidewall includes a first arcuate feature extending from a lower corner of the first sidewall to a first lower corner of the third sidewall and the second sidewall includes a second arcuate feature extending from a lower corner of the second sidewall to a second lower corner of the third sidewall.

5. The device of claim 4, wherein a section of the continuous wall forms a fourth sidewall, opposite the third sidewall, wherein the first side wall, the second sidewall, the third sidewall, and fourth sidewall form an aperture, wherein the attachment portion is configured to be disposed over a post portion of the support structure through the aperture.

6. The device of claim 5, wherein one or more triangular features are re substantially along a tangent line and extend radially outward from the continuous wall to connect between the continuous wall and the first sidewall and between the continuous wall and the second sidewall.

7. The device of claim 1, wherein the attachment portion is configured to slidably engage with the support structure.

8. The device of claim 1, wherein an upper edge of the continuous wall is proximate the opening of the holder portion, wherein the upper edge of the continuous wall is rounded, wherein a lower edge of the continuous wall is proximate the base, and wherein the lower edge of the continuous sidewall is flat.

9. The device of claim 1, wherein a thickness of the continuous wall is about 0.01 inches to about 0.15 inches.

10. The device of claim 1, wherein a width of the attachment portion is about 2 inches to about 3 inches.

11. The device of any of claim 1, wherein a thickness of each of the first sidewall, the second sidewall, and the third sidewall is about 0.2 inches.

12. The device of claim 1, wherein a height of the holder portion is about 3 inches.

13. The device of claim 1, wherein a height of the attachment portion is about 2.7 inches.

14. The device of claim 1, wherein a width of the holder portion is about 3 inches to about 5 inches.

15. The device of claim 1, wherein the holder portion has a generally cylindrical shape.

16. The device of claim 1, wherein the device is additively manufactured.

17. The device of claim 16, wherein the holder portion and the attachment portion are integrally formed.

18. The device of claim 1, wherein the vessel includes cups, flowerpots, and/or bottles, and wherein the support structure includes a bed frame.

19. A cup holder for holding a cup, the cup holder configured for attachment to a support structure, the cup holder comprising:

a cup holder portion defining a cup holder interior configured to accept a cup and support the cup therein, wherein the cup holder portion includes:

a circular base configured to seat the cup thereon defining a circumferential lower cup holder edge about a central cup axis;

a continuous peripheral sidewall extending axially from the lower cup holder edge to an upper cup holder edge; and an opening defined in the continuous peripheral sidewall to allow access to the cup holder interior; and an attachment portion for attaching the cup holder to a structure engaged with or integrally formed with the continuous peripheral sidewall, wherein the attachment portion includes, a polygonal aperture defining an upper attachment edge about an attachment axis;

a first side extending axially downward from the upper attachment edge to a first lower attachment edge and extending radially outward from the continuous peripheral sidewall in a first direction;

a second side extending axially downward from the upper attachment edge to a second lower attachment edge and extending radially outward from the continuous peripheral sidewall in a second direction; and a third side extending axially downward from the upper attachment edge to a third lower attachment edge and extending between the first and second sides, wherein the third lower attachment edge is above the first and second lower attachment edges, wherein a portion of continuous peripheral sidewall forms a fourth side, the first, second, third, and fourth sides forming an outer boundary of the aperture, wherein the aperture is configured to slidably engage with the structure along the attachment axis to attach the cup holder to the structure.

* * * * *